United States Patent [19]

Nania

[11] 4,455,793

[45] Jun. 26, 1984

[54] PREFABRICATED BUILDING BLOCK AND CIVIL BUILDING COMPOSED OF A PLURALITY OF SUCH BLOCKS ASSEMBLED TOGETHER

[76] Inventor: Franco Nania, Via delle Ninfe 37, Marsala, Trapani, Italy

[21] Appl. No.: 283,464

[22] Filed: Jul. 15, 1981

[30] Foreign Application Priority Data

Jul. 16, 1980 [IT] Italy ..... 23493 A/80

[51] Int. Cl.[3] ..... E04B 7/02

[52] U.S. Cl. ..... 52/91; 52/86; 52/94; 52/309.12

[58] Field of Search ..... 52/11, 16, 86, 90, 91, 52/94, 309.12, 262, 309.7, 95, 79.1, 309.16, 309.17

[56] References Cited

U.S. PATENT DOCUMENTS

| | | | |
|---|---|---|---|
| 1,111,131 | 9/1914 | Broughton | 52/91 X |
| 1,280,726 | 10/1918 | Havens | 52/91 X |
| 3,201,907 | 8/1965 | Henderson | 52/91 X |
| 3,410,044 | 11/1968 | Moog | 52/300 X |
| 3,665,662 | 5/1972 | Timbrook et al. | 52/92 |
| 3,828,496 | 8/1974 | Testaguzza et al. | 52/91 |
| 3,898,776 | 8/1975 | Cox et al. | 52/79 |
| 4,094,110 | 6/1978 | Dickens et al. | 52/80 |
| 4,187,651 | 2/1980 | Tolsma | 52/79.1 |
| 4,249,354 | 2/1981 | Wynn | 52/438 |

FOREIGN PATENT DOCUMENTS

| | | | |
|---|---|---|---|
| 205807 | 2/1957 | Australia | 52/91 |
| 259421 | 10/1926 | United Kingdom | 52/91 |

*Primary Examiner*—Alfred C. Perham
*Assistant Examiner*—David J. Thomas
*Attorney, Agent, or Firm*—Cushman, Darby & Cushman

[57] ABSTRACT

A building block for prefabricated constructions comprises a wall portion and a covering portion made of expanded plastics material.

A number of through-tubes run vertically along the wall thickness of the wall portions, the covering portion being united by joints and adhesives to the wall portion unless they are moulded as a single entity. The tubes and the open spaces serve to receive a concrete casting which unites all the component parts of the block together to form a single rigid entity.

9 Claims, 8 Drawing Figures

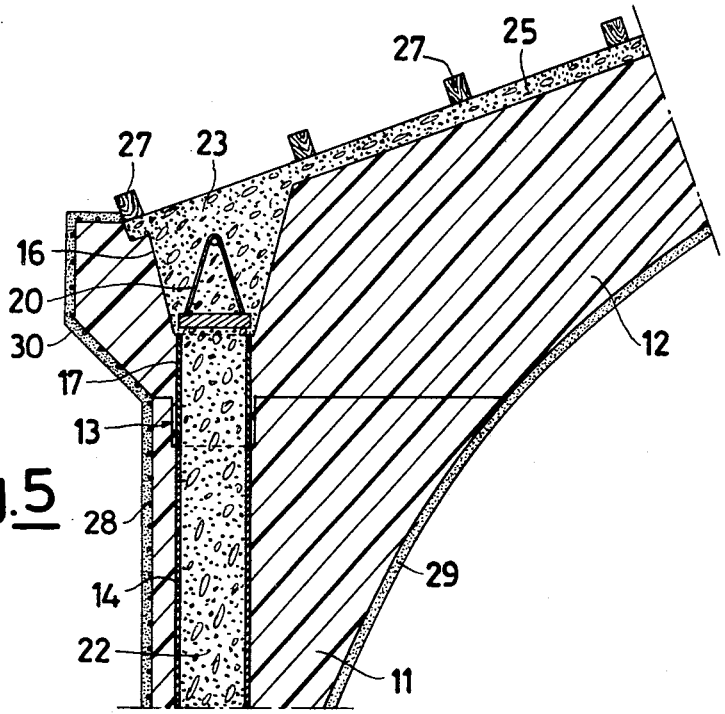
Fig.5
Fig.6
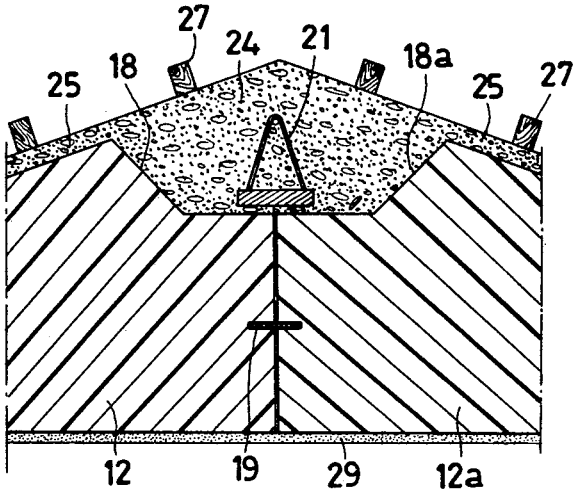

PREFABRICATED BUILDING BLOCK AND CIVIL BUILDING COMPOSED OF A PLURALITY OF SUCH BLOCKS ASSEMBLED TOGETHER

This invention relates to a prefabricated building block and a civil building obtained by assembling a plurality of such blocks together.

Prefabricated building blocks are known in a number of various embodiments. Usually, they are reinforced-concrete, or concrete blocks obtained by casting into appropriate moulds, but also elements made of a plastics material are known. In a few cases, wall blocks have been suggested, which have the height of a story of the building intended to be constructed therewith.

Such conventional prefabricated building blocks, which are generally modular, have originated the so-called prefabricated buildings: these have acquired in recent years a wider and wider acceptance by virtue of their cheapness and the reduction of labour in their erection.

However, the prefabricated blocks adopted heretofore are all comparatively heavy so that they cannot be conveniently handled in shipment and erection. In addition, they are generally simple wall members, so that it is required that foundation work, covering the building and other operations be performed in situ. Also the insulation against heat and sound propagation which can be obtained with conventional blocks is rather poor.

An object of the invention is principally that of providing a building block which is particularly lightweight for prefabricated modular buildings having a single story which, in addition to being easily and cheaply constructed, is handy, rapidly assemblable on the spot and permits to erect buildings, such as houses, schools, hospitals, entertainment premises and the like having very good resistance against earthquake shocks. Another object is to provide a member which is inherently heat-and noise insulating so as to dispense with any discrete insulation treatment and to provide civil buildings which do not require any central heating installations, even in highly mountainous territories.

To achieve this object it has been envisaged to provide a prefabricated building block of a moulded expanded plastics material, which comprises a wall portion having the height of one storey of the building and a covering portion, in the wall portion there being embedded at least two spaced apart through-tubes and the covering portion having at its base a space open upwards and communicating with said tubes in the wall portion, an upward open half-space in correspondence of its top.

The embedded tubes or spaces obtained in any manner in the wall portion of the block and the open spaces in the covering portion are intended to receive in situ, upon assembly and the mutual connections of the several members, a casting of concrete, after having appropriately positioned reinforcing irons in the tubes and the open spaces, so as to form in the interior of the prefabricated blocks a supporting structure composed of pillars and curbs and top runners.

The prefabricated block according to the invention can be moulded as an entity, but, with advantage, its wall portion and covering portion are moulded into two discrete members which can be united together by means of a simple mortise-and-tenon coupling and with the use of specially provided adhesives so as to impart to the members thus obtained the same stiffness and resistance as it would have been obtained as an entity by a single moulding step.

The expanded plastics material used for making the block can be expanded polystyrene, expanded polyurethan or foams, also and essentially of the self-extinguishing type. During the moulding stage of the block or its component parts there can be embedded in the mass of expanded plastics material, in addition to the tubes of ferrous or plastics material for the supporting pillars, also a reinforcing structure, for example a metal gauze or another reinforcing member, as well as the frames for the doors and the windows. In addition still in the moulding stage, there can be positioned within the expanded mass all the water and electricity mains.

The modular prefabricated building obtained by assembling a plurality of blocks according to the invention is characterized in that it comprises as a foundation a simple horizontal curb of masonry or concrete with anchoring members for the wall and the covering members of an expanded plastics material, erected on said curb and anchored thereto by concrete pillars cast within the tubes embedded therein, said pillars being mutually connected, in their turn, by a concrete curb cast in the open space provided at the base of the covering portion of the blocks, the tops of the blocks being mutually connected by a concrete top runner cast in the adjoining half open spaces provided at the tops of the covering portions of the blocks, said covering portions being further coated by a layer of concrete and finishing materials on their exposed surfaces.

The other surface of the wall portion of the blocks, after securing thereto a plaster-carrying metal gauze can be finished with a layer of cement mortar and of course also the inner surface might receive the desired finishing.

Lastly, on completion of the work, provision is made to lay the floor both internally and externally with a layer of lean concrete in which it is possible to embed the pipings for the water and electricity lines. In such a layer it is also possible to embed the external plaster-carrying metal gauze which is extended downwards starting from the outer base portion through a length which is appropriate to confer upon the building a contribution of stability.

The invention will be more detailedly described hereinafter with reference to the accompanying drawings which illustrate by way of example only and without limitation the prefabricated building block and a few exemplary embodiments thereof.

More particularly:

Figure 4:
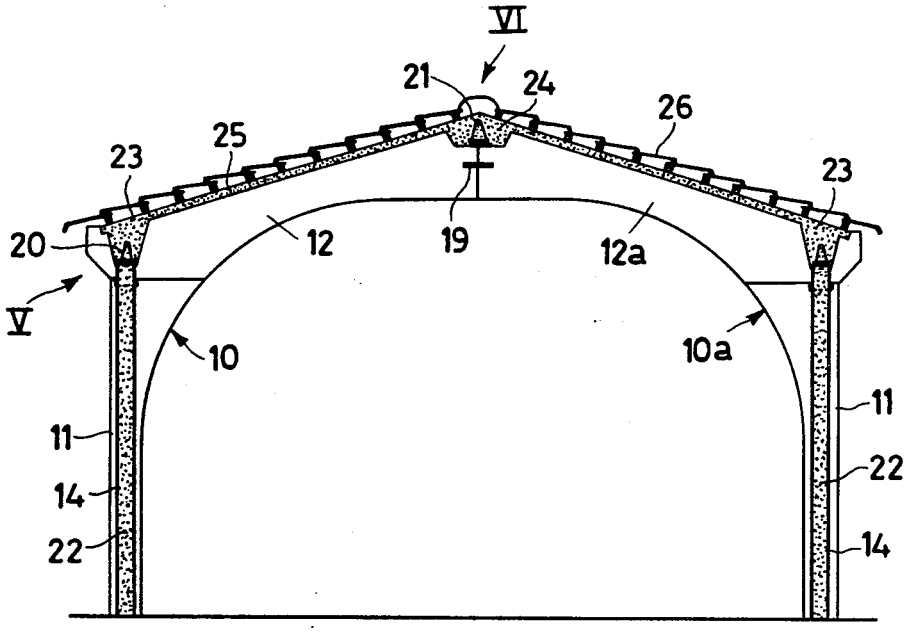
Figure 7:
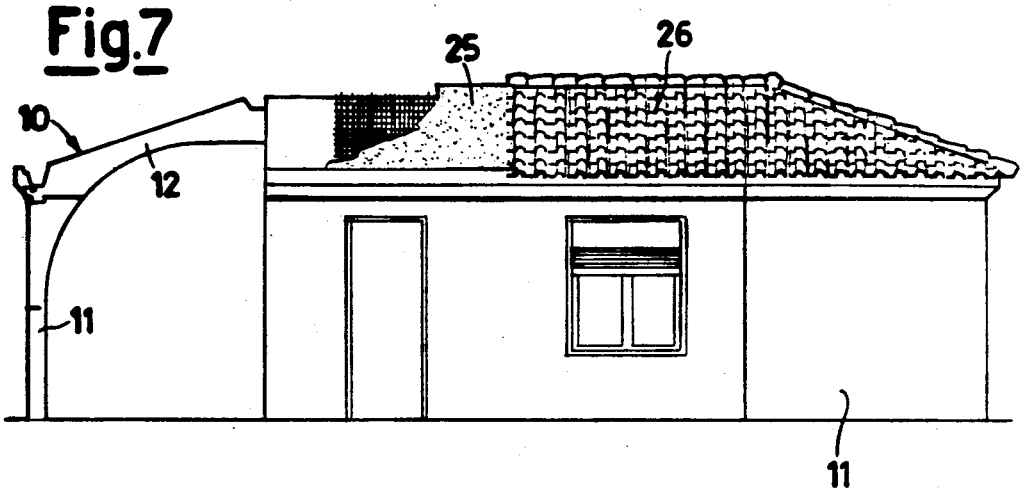
Figure 8:
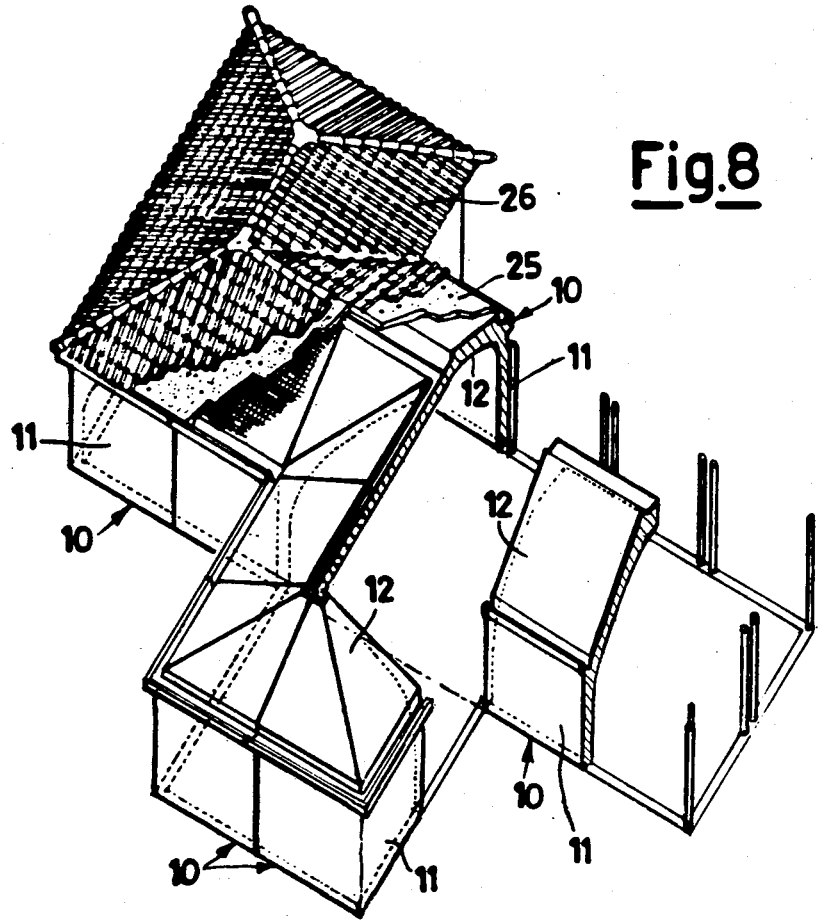

FIG. 4 shows diagrammatically in cross-section two confronting blocks in their installed positions, FIG. 5 shows on an enlarged scale the detail indicated at V in FIG. 4, FIG. 6 likewise shows the detail indicated at VI in FIG. 4, FIG. 7 shows a typical building constructed with prefabricated blocks according to the invention while being installed, and FIG. 8 is an axonometric view of a typical dwelling assembly constructed with the prefabricated blocks in question.

Figure 1:
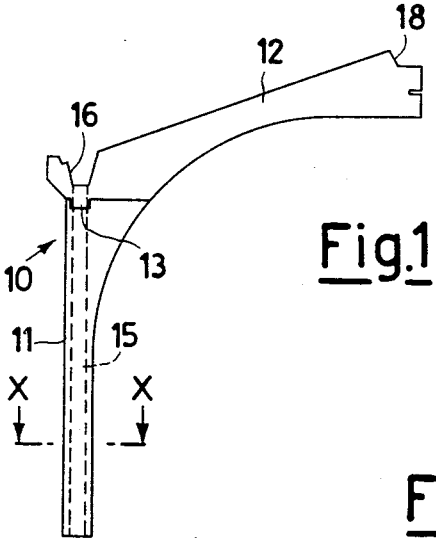
FIG. 1 is a side elevational view of the building block.
Figure 2:
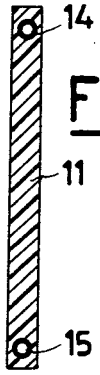
FIG. 2 is a cross-sectional view taken along the line X—X of FIG. 1.
Figure 3:
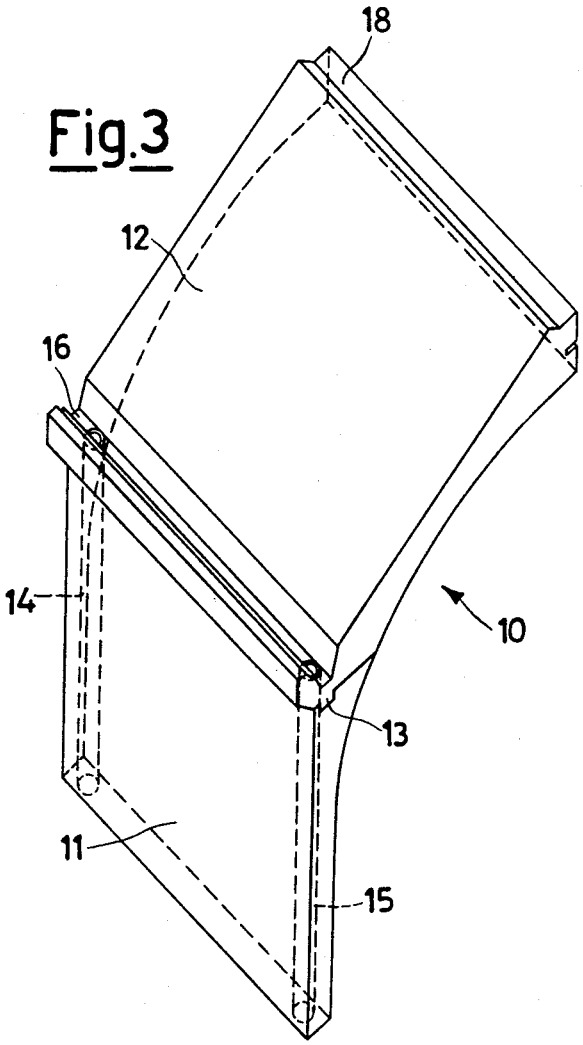
FIG. 3 shows the block in axonometric view.

The prefabricated block of moulded expanded plastics material, generally indicated at 10 in the drawings, comprises a vertical wall portion 11 and a sloping covering portion 12 (see more particularly FIGS. 1–3).

In the example shown the block 10 is made into two discrete pieces, that is to say that the wall portion 11 and the covering portion 12 are obtained separately by moulding, for example with expanded polystyrene, in appropriate moulds. In such a case, the two portions 11 and 12 are united together by means of a mortise-and-tenon union, generally indicated at 13, and with the aid of a special adhesive so as to render the two portions integrally united together to make up an entity as if they had been obtained by a single moulding operation. It is quite possible, of course, to make the entire block 10 as a single entity.

During the mould shaping of the wall portion 11 there are embedded in the expanded mass, in the vicinity of the ends thereof, two tubes, 14, 15 of iron or polyvinyl chloride. In addition, there can be positioned within the expanded mass during moulding all the water and electricity mains (not shown) and there can be located in the mould the frames for possible doors and windows.

If necessary, it is also possible to position in the interior of the expanded mass, during moulding, reinforcing members (not shown), such as iron meshes, tubes and pillars, wood profiles and the like.

The tubes 14, 15 embedded in the wall portion 11 are through-tubes open at both ends.

The covering portion 12, conversely, has at its base a horizontal open space 16 which opens upward which communicates through pipe sections, such as 17 best seen in FIG. 5, with the tubes 14, 15 of the wall portion 11. In addition, in correspondence with its top, the covering portion 12 has a half open-space 18, opened upwards, which is intended to match a homologous half space of another confronting block during assembly (see FIGS. 4 and 6).

The prefabricated building block described in the foregoing affords a number of advantages and qualities, among which its light weight, its high coefficients of heat- and sound insulation, the ease of construction by moulding and thus its cheapness. It can be conveniently shipped to the place of erection and, by virtue of its considerable ease of handling, it can be assembled quickly.

The block thus permits to make up prefabricated modular constructions which, on account of the great versatility of the block, may take the most varied configurations.

With reference to FIGS. 4–8 there will now be described the mode of use of such a prefabricated block.

The erection merely requires the formation of a foundation curb (not shown in the drawings) of masonry or cement concrete, which must be correctly horizontal.

From the curb there are caused to jut upwards at preselected distances, iron stumps as anchoring means to be located within the tubes 14, 15 of the blocks 10.

During assembly, the several blocks 10 are united together by appropriate stiff inserts 19 (see FIGS. 4 and 6 which show two confronting blocks 10 and 10*a*).

On completion of the assembly of the several blocks of the prefabricated building, and on taking into account the fact that corner pieces can be formed from the blocks described hereinbefore by an appropriate vertical cut, iron girders 20, 21 are positioned or also prestressed concrete beams, into the open spaces 16 and the adjoining half spaces 18, 18*a* of the covering portions 12, 12*a* of the assembled blocks. At this stage, a casting of cement concrete is effected into said spaces 16, 18–18*a* so as to fill also the tubes 14, 15 of the blocks to form therein supporting pillars 22 for the curbs 23 and top runners 24 formed in the spaces 16 and 18–18*a*.

Simultaneously, concrete is also laid on the exposed surface of the covering portions 11 of the blocks to provide a covering layer 25.

By so doing, a half-frame structure is obtained which is composed of pillars 22, curb runners 23 and top runners 24 and a thin covering layer 25.

The roof can be finished in a number of ways: either with Marseilles tiles or earthware tiles 26 anchored to wood runners 27 as illustrated by way of example in the drawings, or with other covering materials available in the trade.

The outer surface of the wall, upon securing a plaster-carrying metal gauze 28, is finished with a layer 30 of cement mortar and the inner wall is finished with a layer 29 of cement plaster.

On completion of the work there is laid on the floor both internally and externally, a layer of lean concrete (not shown) in which the pipes for the electric and water mains are embedded.

In such a cement layer it is also possible to embed the outer metal gauze 28, which is caused to overrun to this purpose for a certain width from the outer edge of the base so as to imparts additional rigidity to the building.

FIGS. 7 and 8 show by way of example only two types of dwelling units constructed by using the prefabricated building blocks 10, during the erection and finishing stages.

The advantages of such a building are mainly that it can rapidly be built and erected and finished without requiring any foundation work, it does not necessitate, in practice, any central heating appliances due to the insulation power of the prefabricated blocks, it does not require any special upkeep, it is resistant to earthquake shocks in an outstanding way, it is resistant to fire and is extremely cheap.

I claim:

1. A prefabricated building construction of a plurality of building units of molded synthetic material comprising a plurality of wall members being at least one story in height, each having at least two vertical, horizontally spaced-apart tubes embedded therein, at least two roof sections, each having an upwardly open horizontal trough portion at its lower end and an upwardly open space at its upper end, and a filling of concrete in the lower trough portion of the roof member and in the vertical tubes of the wall member with concrete to form reinforcing concrete pillars within the wall members integral with the resulting horizontal concrete runner of the roof member.

2. Building block according to claim 1, characterized in that the wall portion and the roof portion are two separately moulded pieces united together by mortise-and-tenon unions and with the aid of an adhesive.

3. Building block according to claim 1, characterized in that additional reinforcing structures are embedded in the molded material.

4. Building block according to claim 1, characterized in that water and electricity mains are positioned in the molded material which forms the wall portion.

5. Building block according to claim 1, characterized in that the frames for doors and/or windows are positioned in the molded material of the wall portion.

6. Building block according to claim 1, characterized in that it is comprised of expanded polystyrene or expanded polyurethan or foams, also and especially of the self-extinguishing type.

7. The building of claim 1 wherein reinforcing members are inserted into the wall tubes and open roof spaces prior to pouring the concrete.

8. The building of claim 1 wherein the outer surface of the roof member is coated with a layer of concrete and finishing materials.

9. A prefabricated building made of a plurality of building members of molded synthetic material comprising at least two opposed wall members being one story in height and having embedded therein at least two vertical, horizontally spaced-apart tubes extending the entire height of the wall, at least two roof members capable of being joined to each other at their upper ends forming the ridge of the building, each of said roof members having an upwardly open space at its lower end communicating with the tubes of the wall members, each roof member further comprising an upwardly open space at its upper end, a foundation of a horizontal curb of concrete provided with anchoring means embedded therein and extending upwardly communicating with the tube members of the wall, a filling of concrete in said upper and lower spaces of the roof members and in the vertical tubes of the wall members so as to form reinforcing pillars within the wall, said pillars having the anchoring members embedded in their lower ends and having their upper ends integral with the concrete within the lower space of the roof members.

* * * * *